United States Patent [19]

Yamanaka

[11] Patent Number: 5,067,310

[45] Date of Patent: Nov. 26, 1991

[54] RAW MATERIAL SUPPLY DEVICE AT A STOW-PACKAGING MACHINE

[75] Inventor: Mitsuaki Yamanaka, Koshigaya, Japan

[73] Assignee: Chuo Packaging Machinery Co., Ltd., Tokyo, Japan

[21] Appl. No.: 574,089

[22] Filed: Aug. 29, 1990

[51] Int. Cl.[5] ..... B65B 9/06

[52] U.S. Cl. ..... 53/551; 53/239; 141/67; 141/105

[58] Field of Search ..... 53/238, 239, 431, 474, 53/526, 551, 552; 141/9, 67, 74, 77, 105, 106

[56] References Cited

U.S. PATENT DOCUMENTS

| | | | |
|---|---|---|---|
| 2,956,383 | 10/1960 | Gausman | 53/526 |
| 3,618,283 | 11/1971 | Moore et al. | 53/431 |
| 4,590,975 | 5/1986 | Credle, Jr. | 141/1 |
| 4,604,854 | 8/1986 | Andreas | 53/239 X |
| 4,606,174 | 8/1986 | Berg | 53/551 X |
| 4,608,810 | 9/1986 | Bordini | 53/551 |
| 4,633,654 | 1/1987 | Sato et al. | 53/526 X |
| 4,738,287 | 4/1988 | Klinkel | 141/67 X |
| 4,872,493 | 10/1989 | Everman | 141/67 X |
| 4,884,602 | 12/1989 | Yamamoto et al. | 141/67 X |

*Primary Examiner*—R. L. Spruill
*Assistant Examiner*—Daniel B. Moon
*Attorney, Agent, or Firm*—Fleit, Jacobson, Cohn, Price, Holman & Stern

[57] ABSTRACT

A material supply device in a stowing and packaging machine wherein a supplied film or sheet (S) is continuously introduced around a vertically placed guide tube (1) and sealed along the length thereof by a sealer (14), and the contents are stowed between upper and lower seals while the film or sheet is sealed across the width thereof at spaced positions by a sealing device (17) to form a packaging member (S'). The contents consists of a liquid material and powder or granular solid material with hygroscopicity and solubility in the liquid body. A liquid supply tube (3) supplying the liquid into the packaging member (S''), and a solid material supply tube (2) supplying the solid material are disposed in the guide tube (1), and have lower ends (18, 19) located below the lowermost end of the guide tube (1), and above the packaging section. A blast pipe (4) supplies a dry gaseous material to prevent the solid body material from getting wet and is disposed internally of the solid body supply tube (2,20).

4 Claims, 5 Drawing Sheets

RAW MATERIAL SUPPLY DEVICE AT A STOW-PACKAGING MACHINE

BACKGROUND OF THE INVENTION

This invention relates a stow-packaging machine wherein a content is stowed into a tubeform packaging member, sealing being effected for making bag-stowed goods, and more particularly to a device for supplying the content to be stowed.

Bag-stowed goods for cooling made by gelation of water and stowed in a packaging bag is known, and for the manufacture of such goods it is possible to use a stow-packaging machine.

A stow-packaging machine is known by Utility Model Laid-open No. SHO-53-106350 and Utility Model Official Publication No. SHO-58-40009, etc., wherein a tubular packaging member is formed from a film or sheet wound in a roll form, and sealed directly across the longitudinal direction of the tubular packaging member at a constant interval, stowing of contents being performed.

When manufacturing the material to be stowed, it is necessary to have gelation material dissolved in the liquid, and conventionally, after the liquid has been gelatinized and stowed it is dropped down into a tubular packaging member, or by means of a pump for gelatinized material, to stow it into a packaging member. In this case, it is not necessary to change the basic construction of the stow-packaging device.

However, when water is gelatinized the time for mixing the gelation material into the water is limited, and there is a problem that upon finishing the water absorbing time, it is impossible to obtain a uniform gelation condition even if agitated thereafter. The fact that the water absorbing time is very short causes a problem when more gelation material is dissolved in the water and it may almost be impossible to have a large quantity of water mixed with a large quantity of gelation material to a uniform viscosty.

SUMMARY OF THE INVENTION

Relating to such a problem, the inventor has found, after a longterm study, a method for uniformly dissolving a necessary quantity of gelation material into the liquid such as water by simultaneously and continuously supplying the liquid such as water and a gelation material to that liquid in a small quantity.

Accordingly, the object of the present invention is to provide a material supply device for a stow-packaging machine which is able to obtain a necessary quantity of uniformly gelated liquid by supplying an absorbent solid material with a liquid such as water internally into a packaging member simultaneously and continuously.

The afore-mentioned object is attained in the stow-packaging machine for manufacturing stowed goods of this invention by introducing a film or sheet to be supplied continuously around a guide tube so that it is formed into a tubeform with the supply direction as the axis, forming a tubeform packaging member by sealing both side edges in the supply direction, and while sealing the packaging member intermittently in the direction transverse to the supply direction, stowing the contents into the packaging member. The packaging member for the stowed goods has a length almost equal to the length between the two seal positions, and the contents consists of a liquid and solid body material in powder or granular form which is hygroscopic and soluble in the liquid. A liquid supply pipe supplies the liquid into the tubform packaging member through the guide tube, and a solid material supply pipe supplies the solid body material into the packaging member through the guide tube. A blower supplies dry vapor into the solid material supply pipe for preventing the solid body material from coagulating due to humidity.

The liquid supply pipe is a means for supplying liquid into the tubeform packaging member and the solid body supply pipe is a means for supplying solid body material into the tubeform packaging member each independently from each other, and they are also means for maintaining the liquid and solid material separated from each other so that they will not mix with each other until intended, or just before mixing together. Since the liquid and solid material are supplied into the packaging member continuously through both pipes, the amounts supplied for stowing are set freely in accordance with the time for supplying the raw material.

The blast pipe is a means for keeping the solid material raw material from becoming wet until it becomes mixed with the liquid so that the peculiar quality may be maintained. Particularly, when the solid material is supplied in a powder or lightweight granulated state, it may be affected by the air current from the blast pipe and the solid body material may be scattered and/or disturbed thereby so that care must be taken in designing the device.

In this device, when manufacturing the product material, water is used for liquid and gelation material for solid body material, but it will become apparent from the disclosure that the device is usable also with liquid other than water that can be gelated.

BRIEF DESCRIPTION OF THE DRAWING

An embodiment of a raw material supply device of the stow-packaging machine of this invention is shown in the accompanying drawings, wherein.

DETAILED DESCRIPTION

Figure 1:
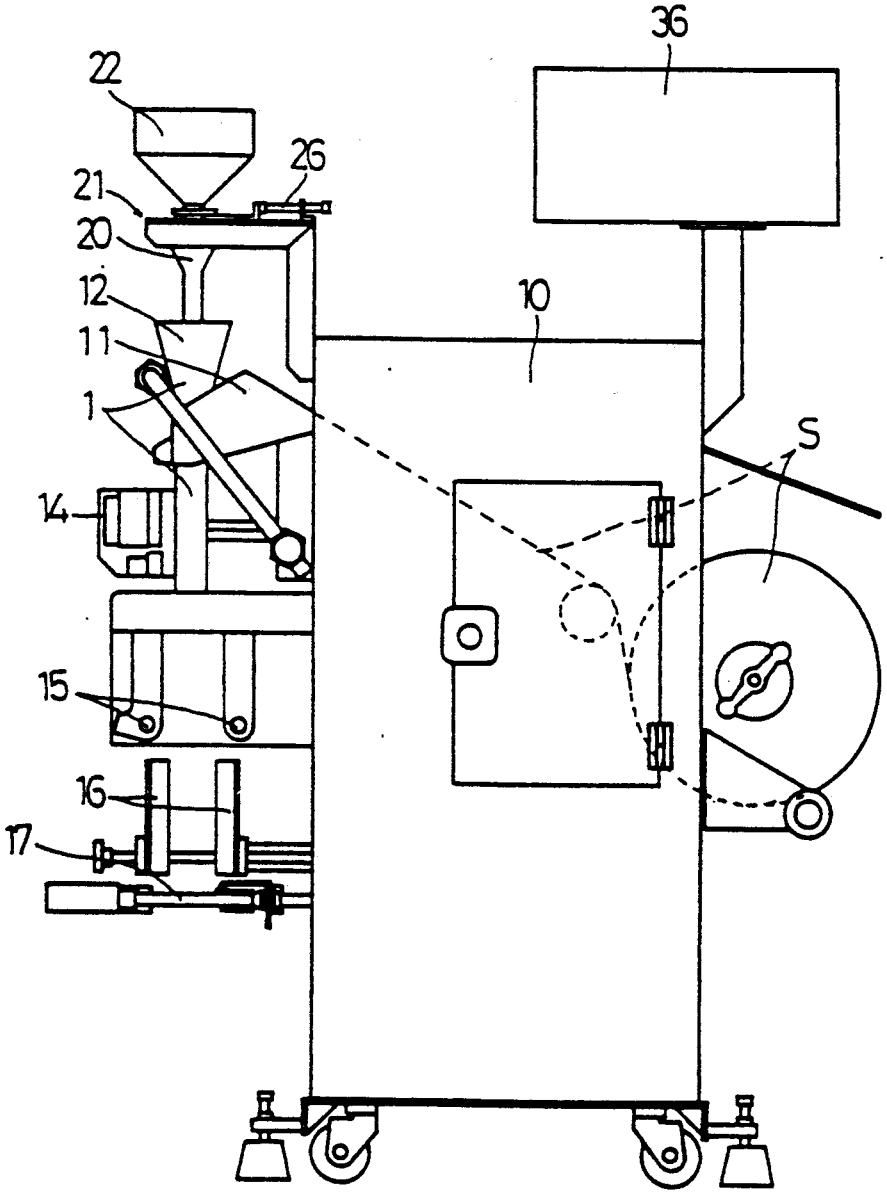
FIG. 1 is a side elevational view of the entire stow-packaging machine of the invention.
Figure 2:
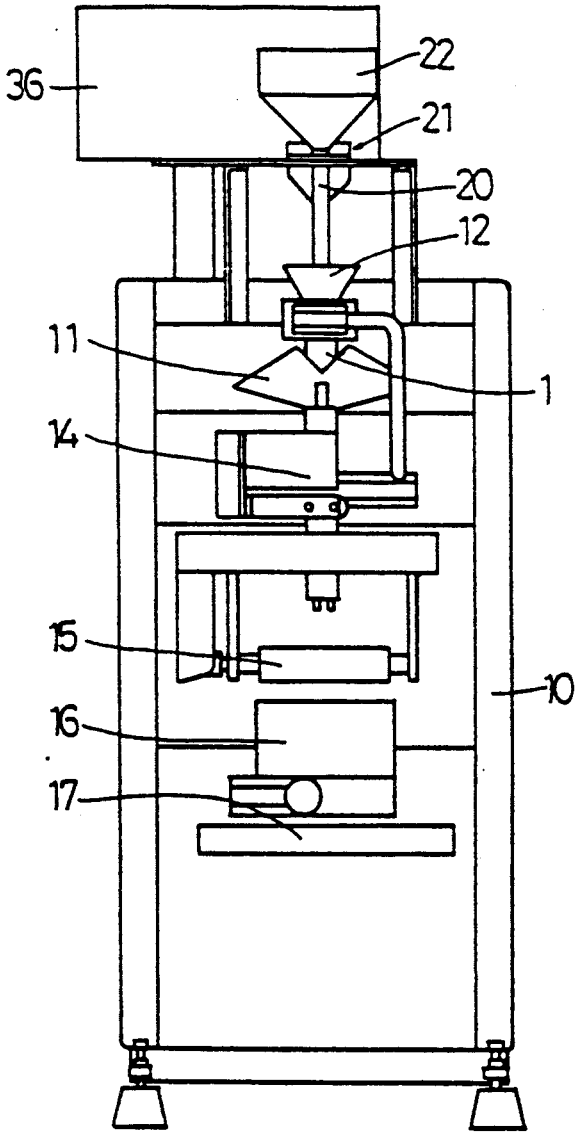
FIG. 2 is a front elevational view thereof.

The invention will now be explained in detail with reference to the accompanying drawing.

The stow-packaging machine is provided internally in the machine body 10 with a roll of film or sheet of packaging body raw material S and in order to guide the raw material S so as to wind it around the outer surface of the guide tube 1 there is fitted on the front upper part of the machine a guide plate 11 having a guide surface which reverses the raw material S from the upper back side to the front lower side surrounding the guide tube 1 from the back side to the front side.

Guide tube 1 passes through the central part of the guide plate up and down and has a somewhat bugle-form introduction portion 12 at the part above the guide plate 11. 13, 13 is a pair of guide pieces provided in front of the guide plate 11 surrounding the guide tube 1 and both side edges of the raw material S are introduced between the guide pieces 13, 13 and both side edges are heated by the tube seal section 14 provided in front of the lower guide tube so that the raw material S becomes the packaging member S' formed in the tubeform state.

Member S' passes through a pair of squeezing rolls 15 directly under the seal part so as to be positioned at the lowermost part through a pair of deairing plates 16, 16 provided in front and back positions and is heated at the seal portion 17 sealing the packaging member S' in the width direction.

Squeezing rolls 15, 15 and the deairing plates 16, 16 press the contents from the front and back sides of the packaging member S' so that they are accessible to and separable from each other.

Figure 4:
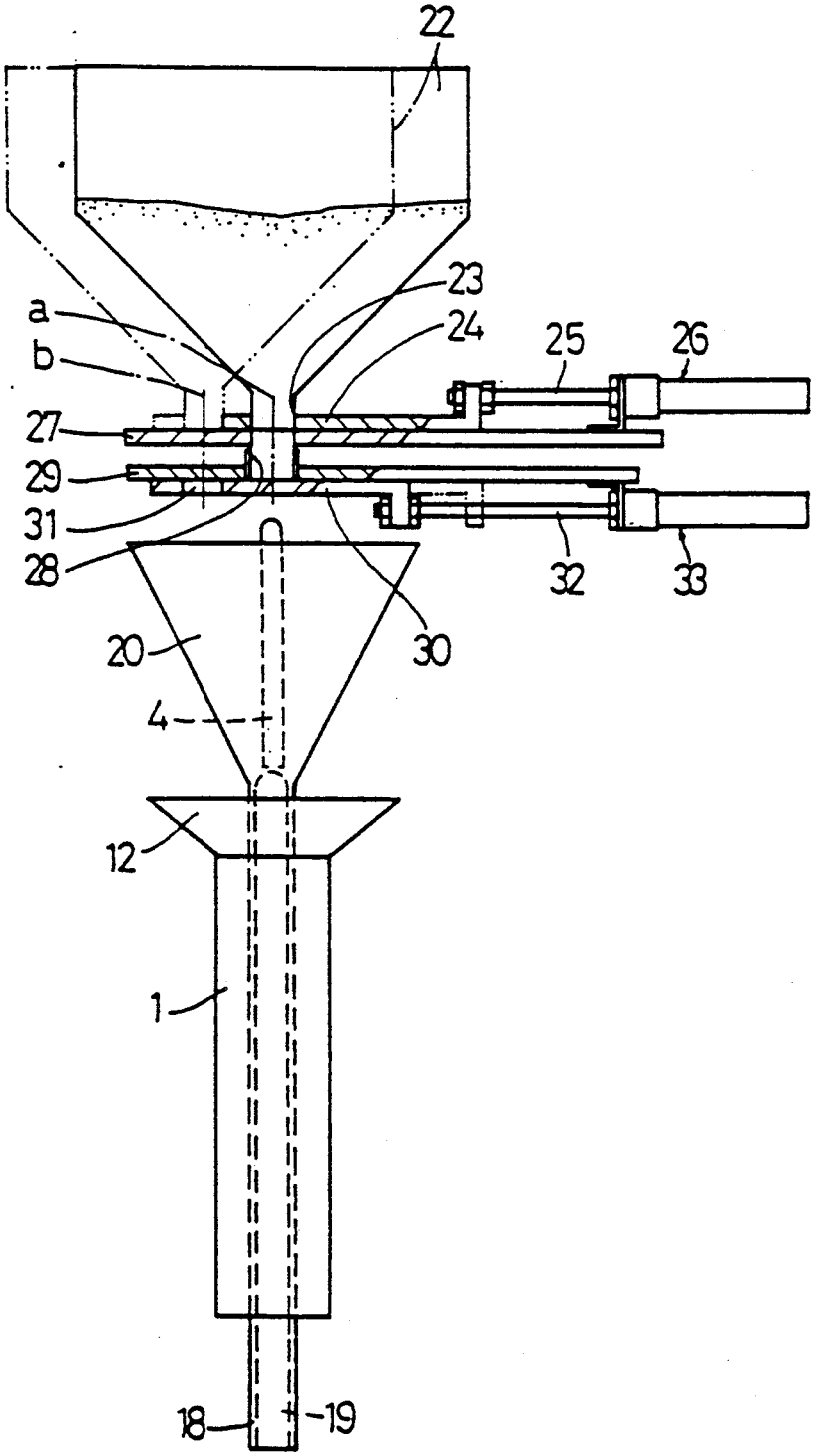
FIG. 4 is an enlarged side view partially broken away of the supply mechanism for liquid, solid body and dry gaseous body.
Figure 5:
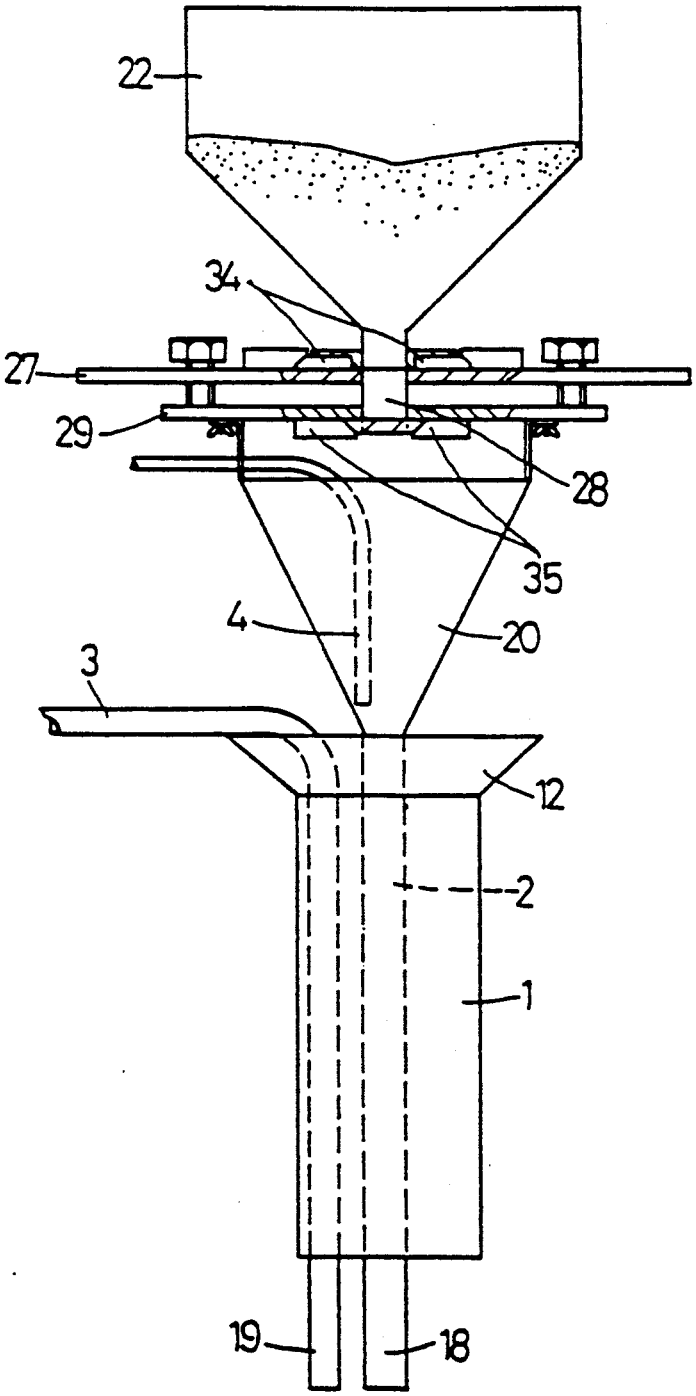
FIG. 5 is a front elevational view of FIG. 4.

The solid material supply pipe 2 and water supply pipe 3 are introduced into the guide tube 1 from the upper taper-form portion 12 and both pipes 2, 3 pass internally through the guide tube 1 from above to below the lower part theread in a downward direction and have lower tip portions 18, 19, respectively, which extend nearly to the rolls 15. The tip portions 18, 19 of both pipes 2, 3 are almost in the same position (FIG. 4 and FIG. 5).

The water supply pipe 3 consists of a relatively slender pipe and is intended to equally gelate water by dissolving powder with a relatively small amount of water.

The solid material supply pipe 2 has a supply mouth 20 with the upper end extended in bugle form and the powder material is supplied in a fixed amount from the upper supply machine 21. Also, in order to prevent the powder material to this supply section from being humidified and coagulated, a blast pipe 4 is provided for blowing in dry vapor.

Figure 3:
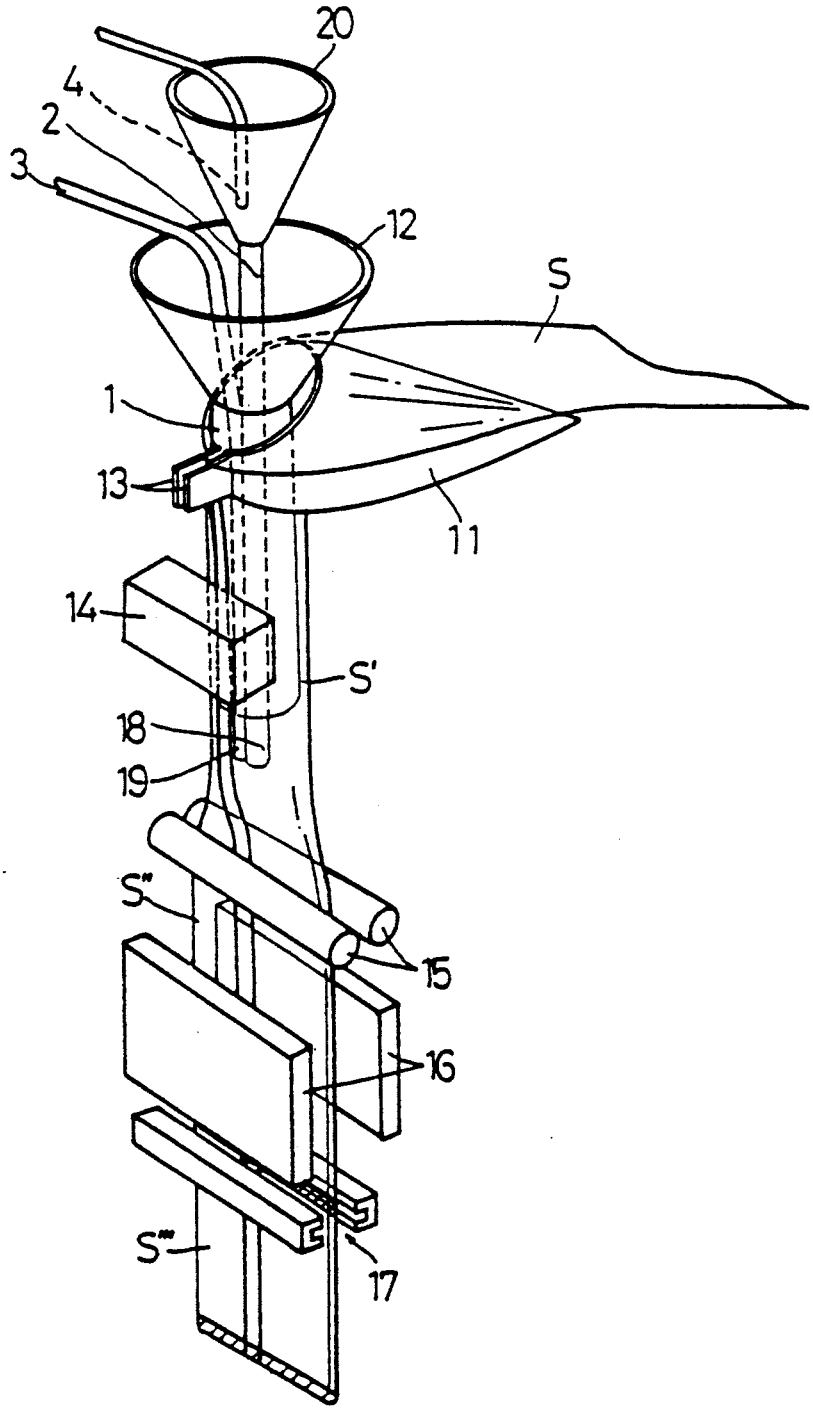
FIG. 3 is a perspective schematic view showing the main part of the device of this invention.

The blast pipe 4 is disposed with its tip directed internally to the solid material supply pipe 2 (FIG. 3). The gaseous body to be used may be dry air when water is gelated. The dry gaseous material is not required to be faster than the supply speed of the powder material, but it may not disturb the flow of the powder material or agitate it actively. Also, it is preferable that the powder material not be scattered to the water supply pipe 3.

The supply mechanism 21 of said powder body is provided with the supply source funnel-form hopper 22, the upper slide plate 24 fixed with the hopper lower end outlet 23, the cylinder mechanism 26 for reciprocating the hopper 22 by the piston 25 connected to the sliding plate end portion, the upper plate 27 arranged to carry the upper slide plate 24 for reciprocating between the introducing position a and the outlet position b and provided with an opening, the lower plate 29 disposed under the upper plate 27 and provided with the measuring tube 28 at the outlet position b between both upper and lower plates, and the lower slide plate 30 mounted on the lower surface of lower plate 29 so as to be able to reciprocate between the position a on the solid material supply passage and the side position b shifted from position a and where solid material outlet 23 is closed. From the conveyance outlet 31 powder material is supplied falling down into supply mouth 20.

Piston 32 is connected to the end portion of the lower slide plate 30; 33 is the cylinder mechanism for driving piston 32; 34, 35 are the guide members for the upper and lower slide plates, respectively; and 36 is the central control board for operating this device.

In the above-described construction, the raw material S is wound on the guide tube 1 from the guide plate 11 and becomes the tubeform packaging member S' at the tubeform seal section 14 and is brought to the state where the bottom of the bag is formed at the seal section 17 in the side direction.

The powder material is supplied from the supply mechanism 21 into the bag body S" opened at the upper side through the solid material supply pipe 2 and at the same time water is supplied from the supply pipe 3 so that the powder material and water is mixed in the bag body S" with the result that the powder material is dissolved to gelate the water. At that time, the powder material is carried to the end part together with the dry gaseous material by the solid body supply pipe 2 carrying no moisture at all and well disperses in a relatively small quantity of water forming a uniform gelation condition to fill quantitatively internally the bag body S" and thereafter water and powder supply stops temporarily. Then deairing plate 16, 16 pushes both surfaces of the bag body S" and pushes upwardly the internal gelated water up to the squeezing roller 15, 15.

After this, the bag body S" moves downwardly in the state that both rolls 15, 15 strongly press both surfaces of the bag body which becomes the product S''' with the gelated water fully packaged in the bag with the upper side sealed by the side-seal section 17.

At this time, since the bottom of the bag body S" for the next product has been formed the rolls and the deairing plates separate from each other and thereafter the operation of supplying the powder material and water is repeated as described before.

Thus, the present invention directly, continuously and simutaneously mixes and stows the moisture preventing and water soluble solid material in the bag in a small quantity so that the solid material can well be mixed with the water providing a high quality stowing packaging article with the solid body uniformly dispersed in the water. Since the solid material is supplied into the bag together with the dry gaseous body the supply pipe does not get clogged by sucking moisture during the supplying operation. As a result thereof, the hopper for dissolving the solid material of gelation material, the pump for pumping viscous material, and a high cost packaging machine for viscous material, etc. that have been conventionally required all become unnecessary, and furthermore repetition of cleaning and conservation become unnecessary.

I claim:

1. In a material packaging machine having means for feeding film or sheet material continuously around a guide tube and forming a tubular packaging member having side edges and a longitudinal axis extending substantially in the feeding direction, said guide tube having upper and lower ends, means for sealing the side edges in the feeding direction, means for sealing the tubular member in a direction transverse to the longitudinal axis intermittently at first and second spaced positions to provide a sealed package for containing contents therein, said second position being above said first position and sealed after sealing said first position, the improvement comprising:

a liquid supply tube disposed in said guide tube for supplying liquid material into said tubular packaging member through said guide tube after sealing at said first position and before sealing at said second position;

said liquid supply tube having a lower end terminating below said lower end of said guide tube;

a solid material supply tube disposed in said guide tube and having an upper end for supplying solid pulverulent material soluble in said liquid material into said tubular packaging member through said guide tube simultaneously with said liquid material;

said solid material supply tube having a lower end at substantially the level of said lower end of said liquid supply tube; and a blast pipe within said solid material supply tube for supplying dry gaseous material into said solid material supply tube for preventing said solid material from being moisturized prior to mixing with said liquid in said tubular packaging member.

2. The improvement as claimed in claim 1 wherein:

said liquid supply tube and said solid material supply tube each have upper end portions of sufficient length so that said supply tubes enter said tubular packaging member across said upper end of said guide tube.

3. The improvement as claimed in claim 1 and further comprising:

a hopper member adjacent to and above said upper end of said solid material supply tube for containing and feeding said solid material to said solid material supply tube;

a lower feeding end on said hopper member;

a pair of upper and lower spaced support plates below and adjacent to said lower feeding end;

a first reciprocating plate slidable on said upper support plate having a hole therein engaging said lower feeding end;

means for reciprocating said first reciprocating plate and said hopper member therewith from a feeding position to a closed position;

a measuring tube hole in said lower support plate aligned with said lower feeding end on said hopper in said feeding position;

a measuring tube supported in said measuring tube hole for receiving and retaining a predetermined amount of said solid material from said hopper in said feeding position;

a second reciprocating plate on said lower support plate;

a feeding hole in said second reciprocating plate; and means for reciprocating said second reciprocating plate for moving said feeding hole from a feeding position aligned with said measuring tube to a closed position where said measuring tube is closed by said second reciprocating plate.

4. The improvement as claimed in claim 3 wherein:

said liquid supply tube and said solid material supply tube each have upper end portions of sufficient length so that said supply tubes enter said tubular packaging member across said upper end of said guide tube.

* * * * *